US006565083B2

(12) United States Patent
Lautenklos et al.

(10) Patent No.: US 6,565,083 B2
(45) Date of Patent: May 20, 2003

(54) DELIVERY FOR A MACHINE FOR PROCESSING SHEET-LIKE PRINTING MATERIALS, IN PARTICULAR, A PRINTING MACHINE

(75) Inventors: Udo Lautenklos, Wald-Michelbach (DE); Martin Buschmann, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/918,055

(22) Filed: Jul. 30, 2001

(65) Prior Publication Data

US 2002/0060411 A1 May 23, 2002

(30) Foreign Application Priority Data

Jul. 28, 2000 (DE) ..... 100 37 304

(51) Int. Cl.[7] ..... B65H 31/32

(52) U.S. Cl. ..... 271/220; 271/189; 271/218; 271/207; 414/790.8

(58) Field of Search ..... 271/189, 207, 271/208, 209, 213, 215, 217, 218, 220; 414/790.8

(56) References Cited

U.S. PATENT DOCUMENTS

| | | | | | |
|---|---|---|---|---|---|
| 3,977,668 | A | * | 8/1976 | Bologna et al. | 271/126 |
| 4,214,745 | A | * | 7/1980 | Morgret | 271/144 |
| 4,838,534 | A | * | 6/1989 | Ishikawa et al. | 271/10.03 |
| 5,090,681 | A | * | 2/1992 | Henn et al. | 271/218 |
| 5,125,639 | A | * | 6/1992 | Henn | 271/189 |
| 5,349,904 | A | * | 9/1994 | Ganter | 101/227 |
| 5,433,429 | A | * | 7/1995 | Muller | 271/189 |
| 5,704,758 | A | * | 1/1998 | Davis et al. | 271/104 |

FOREIGN PATENT DOCUMENTS

| | | | |
|---|---|---|---|
| DE | 29 00 645 | | 7/1980 |
| DE | 3906649 | * | 3/1989 |
| DE | 93 05 757 | | 9/1993 |
| DE | 19905263 | * | 2/1999 |
| DE | 198 08 309 A1 | | 9/1999 |
| DE | 198 08 310 A1 | | 9/1999 |
| DE | 199 05 263 C1 | | 1/2000 |
| DE | 200 08 736 U1 | | 9/2000 |
| DE | 10061005 | * | 6/2001 |
| EP | 845431 | * | 6/1998 |
| GB | 1167219 | | 10/1969 |
| GB | 2 038 785 | | 7/1980 |
| SE | 464 238 | | 12/1968 |

* cited by examiner

*Primary Examiner*—Patrick H. Mackey
(74) *Attorney, Agent, or Firm*—Laurence A. Greenberg; Werner H. Stemer; Ralph E. Locher

(57) ABSTRACT

A delivery of a sheet-processing printing machine has a sheet-pile stacking station whereon a safety guard is provided which is suspended from a pivot pin and, at least during a regular sheet-pile forming process, provides a view of a downline top edge of the sheet pile, as viewed in the processing direction. In this regard, the safety guard is constructed so that it is swingable together and swingable apart in the manner of a hinge, via a hinge pin disposed parallel to the pivot pin; and a machine for processing flat printing materials, and a sheet-processing printing machine, respectively, equipped with the delivery.

15 Claims, 3 Drawing Sheets

DELIVERY FOR A MACHINE FOR PROCESSING SHEET-LIKE PRINTING MATERIALS, IN PARTICULAR, A PRINTING MACHINE

BACKGROUND OF THE INVENTION

Field of the Invention

The invention relates to a delivery for a machine for processing sheet-like printing materials, in particular a printing machine, having a sheet conveyor by which, during operation, sheets are transported to a stacking station whereat a sheet pile is formed from the sheets, and having a safety guard adjustable between a first position and a second position for removing sample sheets preventing access to the sheet conveyor, the safety guard being articulated on the delivery so as to be pivotable about a horizontal pivot pin which is located a distance downline from the sheet pile, as viewed in the sheet transporting direction.

A delivery of the foregoing general type has become known heretofore from the published German Patent Document DE 198 08 309 A1 and serves for removing sample sheets from the sheet pile. Provided for this purpose is a sheet high-holder, which is pivotable about a horizontal pivot pin downline from the sheet pile, into a drop-down path of the sheets released by the sheet conveyor. A safety guard is connected to the sheet high-holder, and thus executes the pivoting movements of the sheet high-holder.

A basically identical device has already been proposed heretofore in the published German Patent Document DE 29 00 645 A1.

The principle common to the state of the art which has been explained hereinbefore stems from the structural combination of the safety guard and a pivotable sheet high-holder.

SUMMARY OF THE INVENTION

It is accordingly an object of the invention to provide a delivery for a machine for processing sheet-like printing materials, in particular, a printing machine, which, in contrast with the delivery to which reference was made in the introduction hereto, is equipped with a separate safety guard which, at least during the regular pile-forming process, provides a view of the downline top edge of the sheet pile.

With the foregoing and other objects in view, there is provided, in accordance with one aspect of the invention, a delivery for a machine for processing sheet-like printing materials, comprising a sheet conveyor for transporting sheets, during operation, to a stacking station whereat a sheet pile is formed from the sheets, and a safety guard adjustable between a first position and a second position at which sample sheets are removable, the safety guard serving to prevent access to the sheet conveyor, and being articulated on the delivery so as to be pivotable about a horizontal pivot pin located at a distance downline from the sheet pile, as viewed in the sheet transporting direction, the safety guard including a first safety-guard section pivotable about the pivot pin, and a second safety-guard section hingedly connected to the first safety-guard section via a hinge pin extending parallel to the pivot pin, the safety guard being swingable together into the first position, and being swingable apart into the second position, respectively, with corresponding pivoting of the first safety-guard section in relation to the pivot pin.

In accordance with another feature of the invention, the first safety-guard section, in the first position, forms a wind deflector for deflecting downline-directed wind substantially transversely to the wind direction.

In accordance with a further feature of the invention, the safety guard, in the second position, has an assumed at least approximately extended or straightened-out position.

In accordance with an added feature of the invention, a distance between the pivot point and the sheet pile is at least approximately bridged by the safety guard in the second position thereof.

In accordance with an additional feature of the invention, the second safety-guard section is constructed as a shield formed with hollows, and the hollows are open in a direction facing towards the sheet pile and, in part, in an upward direction and, in part, in a downward direction.

In accordance with yet another feature of the invention, the second safety-guard section is at least predominantly formed of transparent material.

In accordance with yet a further feature of the invention, the second safety-guard section has viewing openings formed therein which prevent hands of an operator from passing therethrough.

In accordance with yet an added feature of the invention, the safety guard is formed predominantly of transparent material.

In accordance with yet an additional feature of the invention, the second safety-guard section is pivotable manually upwardly from an initial, first position of the safety guard.

In accordance with still another feature of the invention, the delivery includes a signal transmitter actuatable when the second safety-guard section is pivoted upwardly from the initial position thereof.

In accordance with still a further feature of the invention, the delivery includes a slot guide for guiding the second safety-guard section when the safety guard is swung together and apart.

In accordance with still an added feature of the invention, the delivery includes an auxiliary sheet-pile carrier insertable into the stacking station in the transporting direction of the sheets, the auxiliary sheet-pile carrier being insertable into the stacking station only in the first position of the safety guard.

In accordance with still an additional feature of the invention, the adjustability of the safety guard from the first position thereof into the second position is blocked by the insertion of the auxiliary sheet-pile carrier into the stacking station.

In accordance with another aspect of the invention, there is provided a machine for processing flat or planar printing materials, equipped with a delivery comprising a conveyor for transporting printing materials, during operation, to a stacking station whereat a pile is formed from the printing materials, and a safety guard adjustable between a first position and a second position at which samples of the printing materials are removable, the safety guard serving to prevent access to the conveyor, and being articulated on the delivery so as to be pivotable about a horizontal pivot pin located at a distance downline from the pile, as viewed in the transporting direction of the printing materials, the safety guard including a first safety-guard section pivotable about the pivot pin, and a second safety-guard section hingedly connected to the first safety-guard section via a hinge pin extending parallel to the pivot pin, the safety guard being swingable together into the first position, and being swingable apart into the second position, respectively, with corresponding pivoting of the first safety-guard section in relation to the pivot pin.

In accordance with a concomitant aspect of the invention, there is provided a sheet-processing printing machine having a delivery, comprising a sheet conveyor for transporting sheets, during operation, to a stacking station whereat a sheet pile is formed from the sheets, and a safety guard adjustable between a first position and a second position at which sample sheets are removable, the safety guard serving to prevent access to the sheet conveyor, and being articulated on the delivery so as to be pivotable about a horizontal pivot pin located at a distance downline from the sheet pile, as viewed in the sheet transporting direction, the safety guard including a first safety-guard section pivotable about the pivot pin, and a second safety-guard section hingedly connected to the first safety-guard section via a hinge pin extending parallel to the pivot pin, the safety guard being swingable together into the first position, and being swingable apart into the second position, respectively, with corresponding pivoting of the first safety-guard section in relation to the pivot pin.

According to the invention, the safety guard includes, for this purpose, a first safety-guard section, which is pivotable about the pivot pin, and a second safety-guard section, which is connected to the first safety-guard section in a manner similar to that of a hinge, via a hinge pin parallel to the pivot pin, it being possible, with corresponding pivoting of the first safety-guard section relative to the pivot pin, for the safety guard to be swung together into the first position and swung apart into the second position.

In a preferred configuration, the first safety-guard section, in the first position of the safety guard, projects downwardly from the pivot pin, while the second safety-guard section is disposed at an angle relative to the first safety-guard section on that side of the latter which is directed towards the sheet pile or stack. Consequently, on the one hand, the safety guard has a rather small overall height in the first position thereof and, on the other hand, the pivot pin is spaced apart from the sheet pile a distance corresponding at least approximately to the outstretched length of the swung-apart safety-guard sections, with the result that a clearance is produced between the sheet pile and the safety guard located in the first position, this clearance ensuring the possibility of viewing the downline top edge of the sheet pile.

Furthermore, the pivot pin is preferably placed so that, above the pivot pin, it is not possible to gain access in the direction of the sheet pile and the sheet conveyor.

In the first position of the safety guard, the first safety-guard section, which projects downwardly from the pivot pin, prevents accidental access in the direction of the stack, and the second safety-guard section additionally renders deliberate access to the clearance between the safety guard and the stack more difficult, especially since the second safety-guard section preferably assumes an at least approximately horizontal position in the first position of the safety guard. In particular, the safety guard located in the first position thus prevents accidental access to that part of the abovementioned clearance over which, in the case of mechanized sheet high-holders, the latter are automatically displaced from a rest position outside the drop-down path of the sheets into an intercepting position within the drop-down path, with the result that the sheet high-holders do not constitute a hazard.

In the second position of the safety guard, the first section thereof is pivoted upwardly, in relation to the pivot pin, in a direction towards the stack, and, in a preferred configuration, assumes an approximately horizontal position. The two safety-guard sections here are swung apart in relation to the hinge pin and, in a preferred configuration, they assume an at least approximately straightened-out position in relation to one another and virtually bridge the distance between the pivot pin and the stack.

As the two safety-guard sections are swung apart, the second safety-guard section moves beneath the space taken up by the aforementioned sheet high-holders in the rest position thereof and thus prevents access to the sheet high-holders, while the interspace formed in the intercepting position of the Sheet high-holders, between two successive sheets, provides access for removal of a sample sheet.

Other features which are considered as characteristic for the invention are set forth in the appended claims.

Although the invention is illustrated and described herein as embodied in a delivery for a machine for processing sheet-like printing materials, in particular, a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
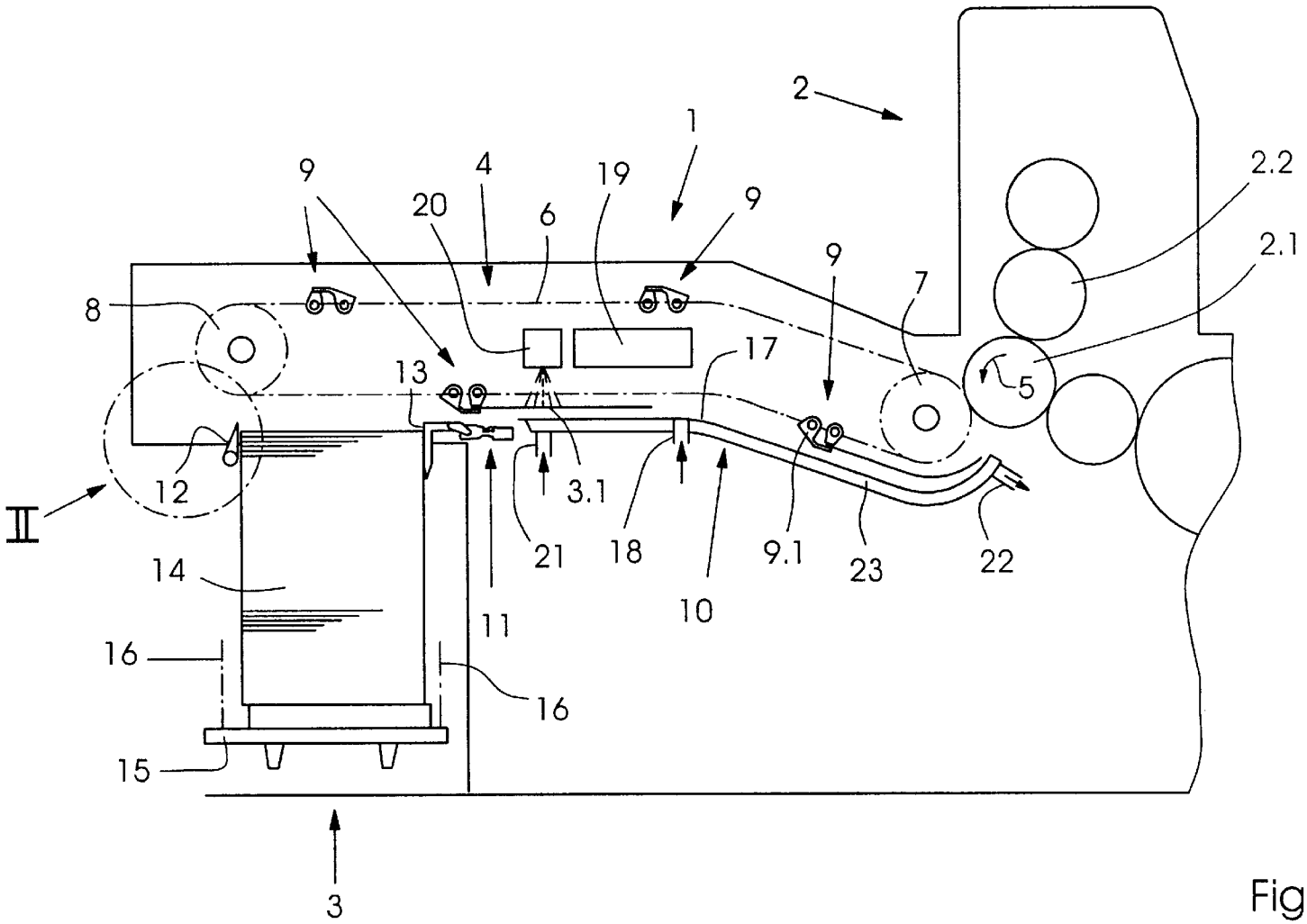
FIG. 1 is a fragmentary diagrammatic side elevational view of a sheet-processing printing machine equipped with a delivery.

Referring now to the drawing and, first, particularly to FIG. 1 thereof, there is shown therein a delivery 1 following a final processing station of a printing machine for processing flat or planar printing materials in the form of sheets 3.1. Such a processing station may be a printing unit or a post-treatment unit, for example a varnishing or coating unit. In the example at hand, the final processing station is an offset printing unit 2 with an impression cylinder 2.1. The latter guides a respective sheet 3.1, in a processing direction indicated by an arrow 5 representing the rotational direction of the impression cylinder 2.1, through a nip between the impression cylinder 2.1 and a blanket cylinder 2.2 cooperating with the impression cylinder 2.1, and then transfers it to a sheet conveyor 4, grippers, which are arranged on the impression cylinder 2.1 and are provided for gripping the sheet 3.1 at a gripper margin located at the leading end of the sheet 3.1, being opened in the process. The sheet conveyor 4 includes two conveying chains 6, respectively, revolving along respective side walls of the delivery 1 during operation. A respective conveying chain 6 wraps around each of two synchronously driven drive chain or sprocket wheels 7, the axes of rotation of which are aligned with one another and, in the example at hand, is guided over a respective guide sprocket or deflecting-chain wheel 8 which is located downline from the drive sprocket wheels 7, as viewed in the processing direction. Extending between the two conveying chains 6 are gripper systems 9, borne by the conveying chains, with grippers 9.1 which pass through gaps between the grippers arranged on the impression cylinder 2.1 and thus receive a respective sheet 3.1, the gripper margin at the leading end of the sheet 3.1 being gripped in the process, immediately before the grippers arranged on the impression cylinder 2.1 are opened, transport the sheet past a sheet-guiding device 10, to a sheet brake 11 and open thereat in order to transfer the sheet 3.1 to the sheet brake 11. The latter imparts to the sheets a depositing speed which is lower than the processing speed, and releases the sheets after they have reached the depositing speed, with the result that a respective, then decelerated sheet 3.1 finally comes into contact with leading-edge stops 12 at a stacking station 3, the sheets being aligned against the leading-edge stops 12 and against trailing-edge stops 13, which are located opposite the leading-edge stops 12 and, together with preceding and/or following sheets 3.1, forming a sheet pile or stack 14, it being possible for the stack 14 to be lowered by a lifting mechanism to the same extent as the stack 14 grows. Of the lifting mechanism, FIG. 1 illustrates only a platform 15 bearing the stack 14, and lifting chains 16 bearing the platform and represented in phantom.

The conveying chains 6, along the paths thereof between the drive sprocket wheels 7, on the one hand, and the guide sprocket wheels 8, on the other hand, are guided by chain guide rails, which thus determine the paths of the chain strands. In the example at hand, the sheets 3.1 are transported by the chain strand which is at the bottom in FIG. 1. That section of the chain path through which the chain strand runs is followed alongside by a sheet-guiding surface 17 which faces towards the chain path and is formed on the sheet-guiding device 10. A carrying air cushion is preferably formed, during operation, between the sheet-guiding surface 17 and the sheet 3.1 guided thereover, respectively. For this purpose, the sheet-guiding device 10 is provided with blast or blowing-air nozzles which open out into the sheet-guiding surface 17, only one of the blast-air nozzles being illustrated symbolically in the form of a stub 18 in FIG. 1 as a representative for all of the blast-air nozzles.

In order to prevent the printed sheets 3.1 in the stack 14 from mutually adhering, a dryer 19 and a spray powder device are provided on the path of the sheets 3.1 from the drive chain wheels 7 to the sheet brake 11.

For the purpose of avoiding excessive heating of the sheet-guiding surface 17 by the dryer 19, a coolant circuit is integrated in the sheet-directing device 10 and is indicated symbolically in FIG. 1 by an inlet stub 21 and an outlet stub 22 on a coolant tray 23 assigned to the sheet-guiding surface 17.

Figure 2:
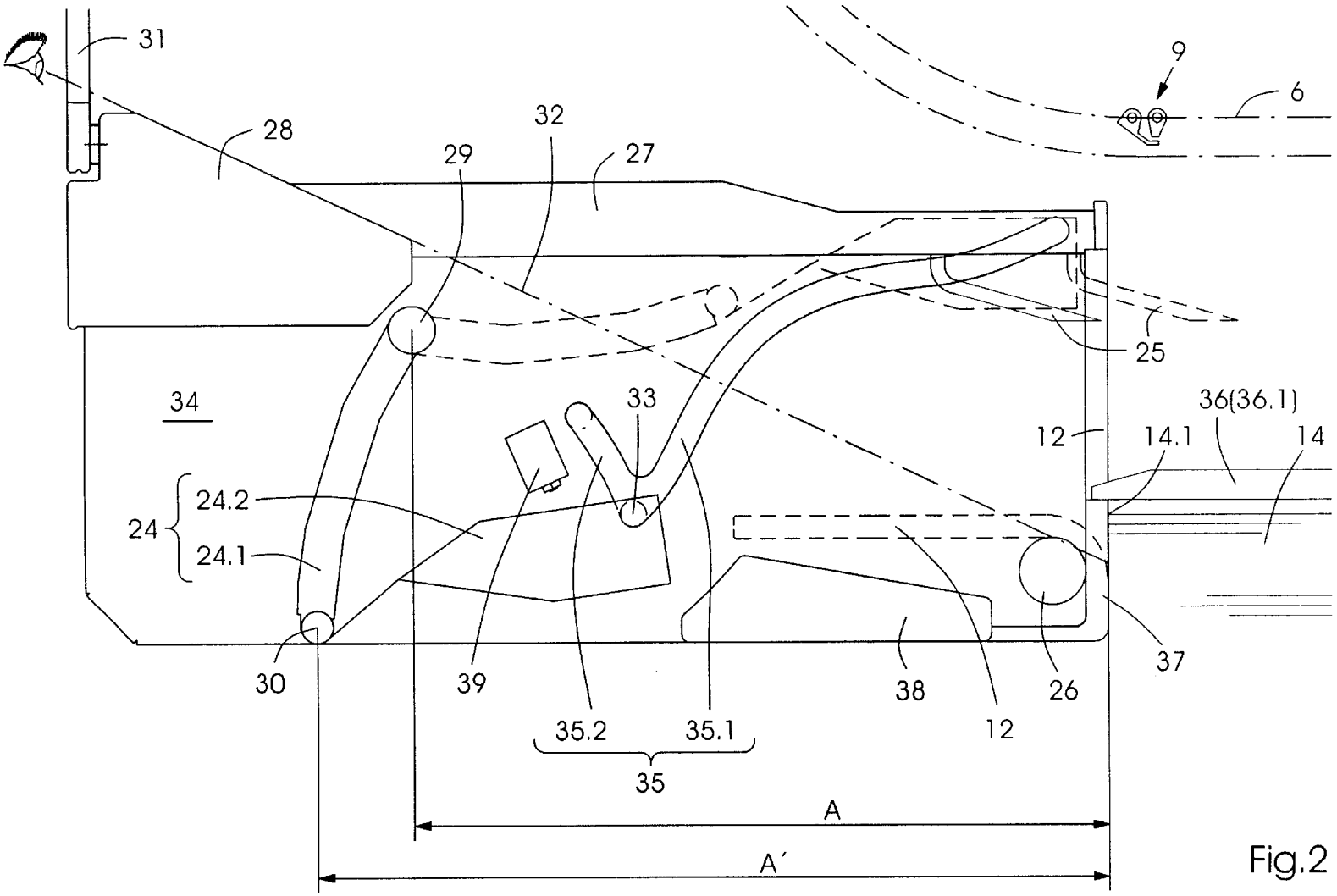
FIG. 2 is an enlarged fragmentary view of FIG. 1 showing the encircled detail II.

FIG. 2 illustrates, in particular, the construction of a safety guard 24 provided in the configuration at hand and also illustrates how to incorporate it in the delivery 1. The latter is equipped with sheet high-holders 25 which, during the regular sheet pile-forming process, are located in a rest position thereof, which is illustrated in solid lines, and, for the purpose of manual removal of sample sheets, assume an intercepting position illustrated in broken lines, wherein they are displaced into the drop-down path. In the configuration at hand, the sheet high-holders 25 are constructed as tines which are displaceable longitudinally along non-illustrated horizontal rectilinear guides from the rest position into the intercepting position and the reverse by also non-illustrated actuating cylinders. The tines are assigned to the leading margins of the sheets 3.1 released by the gripper systems 9 and are arranged successively along the margins so that they pass through the interspaces between the leading-edge stops 12. The leading-edge stops 12 are connected in a manner fixed against rotation relative to a stop shaft 26 and are pivotable by the latter between an upright position, which is illustrated in solid lines, and a release position illustrated in broken lines, wherein the leading-edge stops are swung away from the stack 14 to permit the removal of sample sheets. Respective rectilinear guides and actuating cylinders for the sheet high-holders are partially enclosed by respective panelings 27 and, with this in mind, cannot be seen in the type of illustration selected in FIG. 2. The panelings 27 are connected to a covering 28 enclosing a crossmember also not illustrated in FIG. 2, the crossmember being arranged between the side walls of the delivery 1 at the downline end of the latter, as viewed in the transporting direction of the sheets 3.1. The safety guard 24 includes a first safety-guard section 24.1, which is arranged so that it is pivotable about a horizontal pivot pin 29, and a second safety-guard section 24.2, which is hingedly connected to the first safety-guard section 24.1 via a hinge pin 30 which extends parallel to the pivot pin 29, the pivot pin 29 being located at a distance A downline from the sheet pile or stack 14, as viewed in the transporting direction of the sheets 3.1 and, in the configuration of the delivery 1 at hand, in the immediate vicinity of an upline section of the covering 28.

The safety guard 24 is illustrated in solid lines in the first position thereof and in broken lines in the second position thereof, which is provided for the removal of sample sheets.

In the first position thereof, the first safety-guard section 24.1 extends downwardly from the pivot pin 29. Possibly discounting end sections of the first safety-guard section 24.1 which are directed towards the side walls of the delivery 1, the first safety-guard section has a closed surface and, in the first position thereof, thus forms a wind deflector which deflects downline-directed wind, as viewed in the transporting direction of the sheets. Such a wind is produced, in particular, by the revolving gripper systems 9 when the latter run through a path determined by the bottom strands of the conveying chains as they transport the sheets 3.1 in a direction towards the stacking station 3. In the configuration at hand, this wind, with the second safety-guard section 24.2 being of non-continuous construction preferably at least in the region of the hinge pin 30, is deflected at least approximately downwardly, i.e., virtually transversely to the wind direction. For this purpose, the first safety-guard section 24.1 is inclined in the first position so that an end thereof which is assigned to the hinge pin 30 is spaced apart from the sheet pile or stack 14 a distance A', which is slightly greater than the distance A between the pivot pin 29 and the sheet pile or stack 14. This considerably improves the operating conditions of the delivery 1, which is additionally screened-off or shielded, above the covering 28, by an outwardly swinging see-through panel 31.

In the first position, the second safety-guard section 24.2 is disposed at an angle relative to the first safety-guard section 24.1 on that side of the latter which faces towards the sheet pile or stack 14, and it assumes an at least approximate horizontal position in the process.

A glance through the see-through panel 31 in the direction towards the sheet pile or stack 14 with the eye level of the observer along a line 32 passing over the top side of the covering 28 continues to obtain a view, in the configuration at hand, of the downline top edge 14.1 of the sheet pile or stack 14, as seen in the transporting direction of the sheets 3.1, in the first position of the safety guard 24. This is achieved by the fact that the safety guard 24, in the first position thereof, rather than just being arranged pivotably, as known heretofore, also takes up only a small amount of space beneath the line 32 although, in the second position thereof, it extends from the pivot pin 29 to beyond the leading-edge stops 12, and the aforementioned small amount of space has especially small height dimensions so that it does not have to submit to any reductions in the maximum achievable height of the sheet pile or stack 14 in order to remove the latter from the stacking station 3 in the downline direction, as viewed in the transporting direction of the sheets 3.1. From the first position of the safety guard 24, the first position thereof being illustrated in solid lines in FIG. 2, the safety guard moves, with pivoting of the first safety-guard section 24.1 in relation to the pivot pin 29, into the second position thereof, which is illustrated in broken lines, the pivoting being in a counterclockwise direction in FIG. 2. The second safety-guard section 24.2, which is articulated on the first safety-guard section 24.1 via the hinge pin 30, bears a bolt 33 at the end thereof which is directed away from the hinge pin 30. A slot guide or coulisse 35 is formed in a side panel 34 fixed on a side wall of the delivery 1, the bolt 33 engaging in the slot guide 35. The slot guide 35 forms a first branch 35.1, which guides the bolt 33, and thus the second safety-guard section 24.2, as the first safety-guard section 24.1 is pivoted. In this way, the safety guard 24 can be adjusted between the swung-together first position and the swung-apart second position thereof, wherein the two safety-guard sections 24.1 and 24.2 assume a virtually extended or straightened-out position and, in addition to the revolving gripper systems 9, the second safety-guard section 24.2 also screens or shields, in particular, the sheet high-holders 25, so that, with the leading-edge stops 12 swung away from the sheet pile or stack 14, risk-free manual access for the removal of sample sheets is ensured.

A non-illustrated actuating drive is provided in order to swing the safety guard 24 together and apart, it being possible for the actuating drive to pivot the first safety-guard section 24.1 in relation to the pivot pin 29. In an advantageous configuration, the actuating drive is formed by an articulation-supported, double-acting actuating cylinder which is articulated on the first safety-guard section 24.1.

In an advantageous configuration, the delivery is equipped for a stack changeover during the production run of the printing machine, a so-called non-stop stack changeover. For this purpose, use is preferably made of an arrangement such as is disclosed in the published German Patent Document DE 196 12 294, and, in particular, an auxiliary stack carrier 36 in the form of a rake formed by grid bars 36.1 is provided accordingly, in which case the rake can be inserted into the stacking station 3 in the transporting direction of the sheets 3.1 and, in the inserted position thereof, is supported, by way of the free ends of the grid bars 36.1, on supporting fingers 37 which are fastened on a crossmember 38 that is located downline from the sheet pile or stack 14, as viewed in the transporting direction of the sheets, and, in a manner not illustrated in FIG. 2, is a constituent part of a liftable and lowerable frame for accommodating the aforementioned rake, which can be inserted into the stacking station 3, it being possible to see an end side of the crossmember in FIG. 2.

In relation to this configuration of the delivery 1, precautions are preferably additionally taken in conjunction with the safety guard 24. In particular, the rake 36 can be inserted into the stacking station 3 only in the first position of the safety guard 24. In order to realize this, an actuating drive (not illustrated) is preferably provided for the auxiliary stack carrier 36, constructed in this case as a rake, and linked to the abovementioned actuating drive, acting on the first safety-guard section 24.1, via a corresponding control circuit which includes detectors for the positions of the safety guard 24 and of the auxiliary stack carrier 36.

As the rake is inserted, moreover, the ability to adjust the safety guard 24 from the first position into the second position thereof is blocked. This avoids exposing individuals to risk, which may occur with the grid bars 36.1 coming into contact with the supporting fingers 37.

In the case of a lifting movement of the aforementioned frame including the crossmember 38, it is possible for the crossmember 38 to advance towards the safety guard 24, more specifically the second safety-guard section 24.2, to the extent wherein, with access to the region between the crossmember 38 and the second safety-guard section 24.2, the risk of pinching or crushing may arise if the safety guard 24 is located in the first position thereof and the second safety-guard section 24.2 is thus located in an initial position. In view of this, in a preferred configuration, the second safety-guard section 24.2 can be pivoted manually upwardly from the aforementioned initial position. For this purpose, the guide slot 35 forms a second branch 35.2, which is illustrated as a slot concentric with the hinge pin 30 and serves for accommodating the bolt 33.

A preferred development provides a signal transmitter 39 in the form of a safety switch which is actuated by the second safety-guard section 24.2 being pivoted upwardly from the initial position thereof, and is linked to a control for a lifting drive for the aforementioned frame including the crossmember 38, so that the actuation of the safety switch 39 stops the lifting drive at least when the frame executes an upward movement.

In the second position of the safety guard 24, the second safety-guard section 24.2 is indeed located above the line 32 which, if it constitutes eye level, bounds or limits the field of vision in the downward direction. However, the aforementioned line passes through the see-through panel 31 at the bottom end of the latter and thus represents the worst possible viewing conditions. In practice, however, it is possible to view the region of the downline top edge 14.1 of the stack 14 from an eye level which is a considerable distance above the aforementioned line 32. It is thus the case in practice that a corresponding line which bounds or limits the field of vision in the downward direction in the first position of the safety guard 24, and comes into contact with the stack some distance below the aforementioned top edge 14.1, extends more steeply than the line 32 and only comes into contact with the safety guard, located in the second position thereof, in a region of the second safety-guard section 24.2 which is adjacent to the hinge pin 30.

Figure 3:
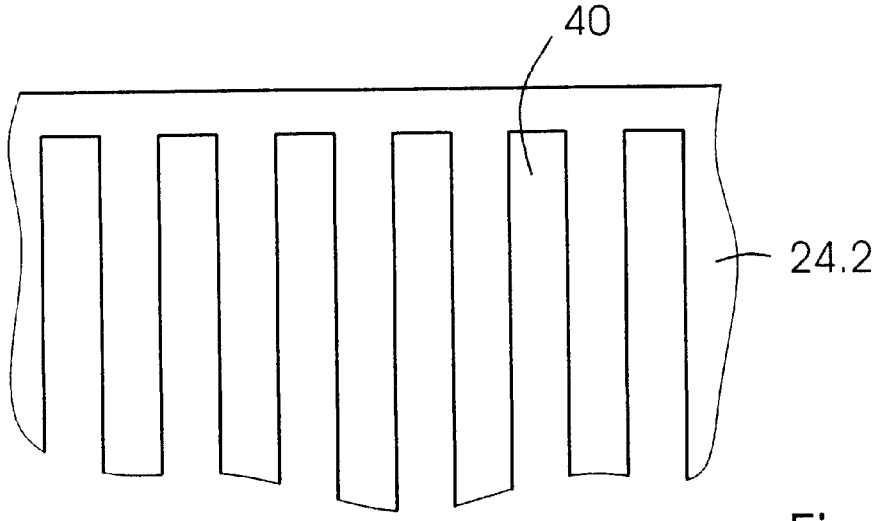
FIG. 3 is an enlarged fragmentary plan view of FIG. 2 showing a detail of the second safety-guard section.

In a preferred configuration of the second safety-guard section 24.2, wherein the latter is provided with viewing openings 40, for example, according to FIG. 3, assurance is thus also provided that, during the removal of sample sheets in the second position of the safety guard 24, it is possible to see the aforementioned downline top edge 14.1 of the stack 14. Furthermore, the viewing openings 40 are constructed so that the operator's hands cannot pass therethrough.

In a configuration alternative thereto, in one embodiment, the entire safety guard 24 is formed predominantly from transparent material and, in another embodiment, the second safety-guard section 24.2 is formed predominantly from transparent material.

Figure 4:
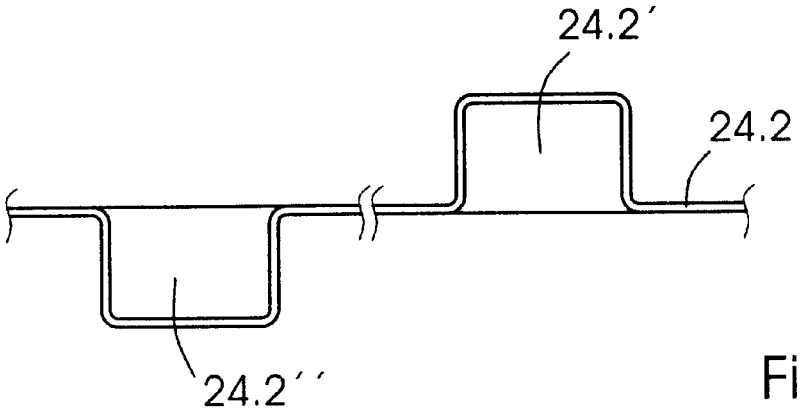
FIG. 4 is an enlarged fragmentary free-end side view of the second safety-guard section of FIG. 3.

In addition, the second safety-guard section 24.2 is preferably constructed in the form of a shield which, in the second position of the safety guard 24, extends at least approximately on a level which is located in the immediate vicinity of and below the panelings 27. The shield is formed with hollows 24.2' and 24.2" which are open in the direction of the stack 14 and, according to FIG. 4, are open in part in the downward direction and in part in the upward direction. The hollows 24.2' open in the downward direction, are assigned to the leading-edge stops 12, extend above the latter in the upright position thereof and provide necessary space for swinging the stops away from the stack 14 into a release position thereof provided for the removal of sample sheets, while the hollows 24.2", which are open in the upward direction, are assigned to the sheet high-holders 25 and extend beneath the latter in the rest position thereof.

We claim:

1. A delivery for a machine for processing sheet-shaped printing materials, comprising:

a sheet conveyor for transporting sheets, during operation, to a stacking station for forming a sheet pile from the sheets at the stacking station, the pile having an upper edge at a level; and a safety guard adjustable between a first position and a second position for removing sample sheets at said second position, said safety guard, in said first position, preventing access to said sheet conveyor and, in said second position, allowing access to said sheet conveyor;

a horizontal pivot pin located at a distance downline from the sheet pile, as viewed in the sheet transporting direction, and at a distance above the upper edge of the pile;

said safety guard being articulated on the delivery so as to be pivotable about said pivot pin;

said safety guard including a first safety-guard section pivotable about said pivot pin and extending, in said first position, from said pivot pin downwardly at least as far as the level of the upper edge of the pile, a hinge pin extending parallel to said pivot pin, and a second safety-guard section hinged to said first safety-guard section via said hinge pin;

said safety-guard sect ions to be swung together into said first position by folding up said safety-guard sections, and to be swung apart into said second position with corresponding upward pivoting of said first safety-guard section with reference to said pivot pin and unfolding said safety-guard sections.

2. The delivery according to claim 1, wherein said first safety-guard section, in said first position, forms a wind deflector for deflecting downline-directed wind substantially transversely to the wind direction.

3. The delivery according to claim 1, wherein said safety guard, in said second position, has an assumed at least approximately extended or straightened-out position.

4. The delivery according to claim 1, wherein the distance between said pivot pin and the sheet pile is at least approximately bridged by said safety guard in said second position thereof.

5. The delivery according to claim 1, wherein said second safety-guard section is constructed as a shield formed with hollows, and said hollows are open in a direction towards the sheet pile and, in part, in an upward direction and, in part, in a downward direction.

6. The delivery according to claim 1, wherein said second safety-guard section is at least predominantly formed of transparent material.

7. The delivery according to claim 1, wherein said second safety guard section has viewing openings formed so that hands of an operator are prevented from passing therethrough.

8. The delivery according to claim 1, wherein said safety guard is formed predominantly of transparent material.

9. The delivery according to claim 1, wherein said second safety-guard section is pivotable manually upwardly from an initial, first position of said safety guard.

10. The delivery according to claim 9, including a signal transmitter actuatable when said second safety-guard section is pivoted upwardly from the initial position thereof.

11. The delivery according to claim 1, including a slot guide for guiding said second safety-guard section when said safety guard is swung from said first position to said second position and vice versa.

12. The delivery according to claim 1, including an auxiliary sheet-pile carrier insertable into said stacking station in said transporting direction of the sheets, said auxiliary sheet-pile carrier being insertable into said stacking station only in said first position of said safety guard.

13. The delivery according to claim 12, wherein said adjustability of said safety guard from said first position thereof into said second position is blocked by the insertion of said auxiliary sheet-pile carrier into said stacking station.

14. A machine for processing flat or planar printing materials, equipped with a delivery comprising:

a sheet conveyor for transporting sheets, during operation, to a stacking station for forming a sheet pile from the sheets at the stacking station, the pile having an upper edge at a level; and a safety guard adjustable between a first position and a second position for removing sample sheets at said second position, said safety guard, in said first position, preventing access to said sheet conveyor arid, in said second position, allowing access to said sheet conveyor;

a horizontal pivot pin located at a distance downline from the sheet pile, as viewed in the sheet transporting direction, and at a distance above the upper edge of the pile;

said safety guard being articulated on the delivery so as to be pivotable about said pivot pin;

said safety guard including a first safety-guard section pivotable about said pivot pin and extending, in said first position, from said pivot pin downwardly at least as far as the level of the upper edge of the pile, a hinge pin extending parallel to said pivot pin, and a second safety-guard section hinged to said first safety-guard section via said hinge pin;

said safety-guard sections to be swung together into said first position by folding up said safety-guard sections, and to be swung apart into said second position with corresponding upward pivoting of said first safety-guard section with reference to said pivot pin and unfolding said safety-guard sections.

15. A sheet-processing printing machine having a delivery, comprising:

a sheet conveyor for transporting sheets, during operation, to a stacking station for forming a sheet pile from the sheets at the stacking station, the pile having an upper edge at a level; and a safety guard adjustable between a first position and a second position for removing sample sheets at said second position, said safety guard, in said first position, preventing access to said sheet conveyor and, in said second position, allowing access to said sheet conveyor;

a horizontal pivot pin located at a distance downline from the sheet pile, as viewed in the sheet transporting direction, and at a distance above the upper edge of the pile;

said safety guard being articulated on the delivery so as to be pivotable about said pivot pin;

said safety guard including a first safety-guard section pivotable about said pivot pin and extending, in said first position, from said pivot pin downwardly at least as far as the level of the upper edge of the pile, a hinge pin extending parallel to said pivot pin, and a second safety-guard section hinged to said first safety-guard section via said hinge pin;

said safety-guard sections to be swung together into said first position by folding up said safety-guard sections, and to be swung apart into said second position with corresponding upward pivoting of said first safety-guard section with reference to said pivot pin and unfolding said safety-guard sections.

* * * * *